US010844756B2

(12) United States Patent
Thielen et al.

(10) Patent No.: US 10,844,756 B2
(45) Date of Patent: Nov. 24, 2020

(54) HYDRAULIC CAMSHAFT ADJUSTER HAVING A MECHANICAL AND A HYDRAULIC RATCHET

(71) Applicant: Schaeffler Technologies AG & Co. KG, Herzogenaurach (DE)

(72) Inventors: Jochen Thielen, Nuremberg (DE); Michael Keck, OT Brunn (DE); Enno Schmitt, Kulmbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/636,440

(22) PCT Filed: Aug. 1, 2018

(86) PCT No.: PCT/DE2018/100674
§ 371 (c)(1),
(2) Date: Feb. 4, 2020

(87) PCT Pub. No.: WO2019/029770
PCT Pub. Date: Feb. 14, 2019

(65) Prior Publication Data

US 2020/0173313 A1 Jun. 4, 2020

(30) Foreign Application Priority Data

Aug. 8, 2017 (DE) ..... 10 2017 117 943

(51) Int. Cl.
*F01L 1/34* (2006.01)
*F01L 1/344* (2006.01)

(52) U.S. Cl.
CPC ... *F01L 1/3442* (2013.01); *F01L 2001/34466* (2013.01); *F01L 2001/34479* (2013.01)

(58) Field of Classification Search
CPC ..... F01L 1/3442; F01L 2001/34463; F01L 2001/34423; F01L 2001/34479;
(Continued)

(56) References Cited

U.S. PATENT DOCUMENTS

2003/0196627 A1 10/2003 Lewis
2015/0322825 A1* 11/2015 Busse ..... F01L 1/3442 123/90.17

FOREIGN PATENT DOCUMENTS

DE 102007004196 A1 7/2008
DE 102012211870 A1 1/2014
(Continued)

*Primary Examiner* — Zelalem Eshete
(74) *Attorney, Agent, or Firm* — Matthew V. Evans

(57) ABSTRACT

The disclosure relates to a hydraulic camshaft adjuster having a stator, which is synchronously rotatable with a crankshaft of the internal combustion engine, a rotor rotatably arranged relative to the stator and synchronously rotatable with a camshaft, two groups of working chambers that can each be loaded with a pressure medium in a pressure medium circuit, and a central locking device for locking the rotor in a defined position relative to the stator. The stator is delimited on a first front end by a multi-part locking cover. The multi-part locking cover has a first locking cover and a second locking cover. A first stage of a mechanical ratchet is formed on the first locking cover, and at least one further stage of the mechanical ratchet is formed on the second locking cover.

20 Claims, 3 Drawing Sheets

(58) Field of Classification Search
CPC ..... F01L 2001/3445; F01L 2001/34469; F01L 2001/34466; F01L 2001/34453
See application file for complete search history.

(56) References Cited

FOREIGN PATENT DOCUMENTS

| | | | |
|---|---|---|---|
| DE | 102013223301 | A1 | 5/2015 |
| DE | 102013224862 | A1 | 6/2015 |
| DE | 102013224857 | A1 | 7/2015 |
| DE | 102014212617 | A1 | 12/2015 |
| DE | 102016218793 | A1 | 7/2017 |

* cited by examiner

HYDRAULIC CAMSHAFT ADJUSTER HAVING A MECHANICAL AND A HYDRAULIC RATCHET

CROSS REFERENCE TO RELATED APPLICATIONS

This application is the U.S. National Phase of PCT Application No. PCT/DE2018/100674 filed on Aug. 1, 2018 which claims priority to DE 10 2017 117 943.7 filed on Aug. 8, 2017, the entire disclosures of which are incorporated by reference herein.

TECHNICAL FIELD

The disclosure relates to a hydraulic camshaft adjuster and to a method for producing a hydraulic camshaft adjuster.

BACKGROUND

Hydraulic camshaft adjusters are used in internal combustion engines in order to adapt a load state of the internal combustion engine and thus to increase the efficiency of the internal combustion engine. Hydraulic camshaft adjusters which operate on the rotary vane principle are known from the prior art. In terms of their basic construction, these camshaft adjusters generally have a stator, which can be driven by a crankshaft of an internal combustion engine, and a rotor, which is connected to the camshaft of the internal combustion engine for conjoint rotation therewith. Between the stator and the rotor there is an annular space which is divided by radially inward-pointing projections connected to the stator for conjoint rotation therewith into a plurality of working chambers, which are each divided by a vane pointing radially outward from the rotor into two pressure chambers. Depending on the supply of a hydraulic pressure medium to the pressure chambers, the position of the rotor relative to the stator and hence also the position of the camshaft relative to the crankshaft can be adjusted in the "advanced" or "retarded" direction. The prior art includes hydraulic camshaft adjusters that have a central locking system, in which the rotor can also be locked in a central position in addition to the respective end positions in order, in particular, to facilitate engine starting. In exceptional cases, however, e.g. in the case of stalling of the internal combustion engine, it is possible that the locking device will not lock the rotor correctly, and it will be necessary to operate the camshaft adjuster with an unlocked rotor in the subsequent starting phase. However, since some internal combustion engines have very poor starting behavior when the rotor is not locked in the central position, the rotor must then be automatically rotated into the central locking position and subsequently locked in the starting phase.

DE10 2012 211 870 A1 discloses a hydraulic camshaft adjuster having a central locking device. Here, the central locking device has a first and a second locking guide slot, wherein the first locking guide slot is formed on a first cover, and the second locking guide slot is formed on a second cover situated opposite the first cover, and the locking pins emerge at opposite ends of the rotor.

DE 10 2014 212 617 A1 discloses a hydraulic camshaft adjuster having a central locking function, wherein the rotor can be rotated out of any position into the central locking position according to the principle of a hydraulic ratchet, wherein a rotary motion counter to this rotation is locked. For this purpose, the hydraulic ratchet uses alternating torques of the camshaft drive in order to pull the rotor from an "advanced" position of adjustment or a "retarded" position of adjustment into the central position, depending on the initial position. To achieve this, one group of working chambers must in each case be closed in order to prevent rotation counter to the intended direction of rotation and to support the corresponding torques of the camshaft. In this case, the locking pins may be arranged either on different sides of the rotor or on the same side. DE 10 2007 004 196 discloses a locking cover having two stacked locking covers mounted on one side.

DE 10 2007 004 196 A1 shows a device for camshaft adjustment on an internal combustion engine, the device having an inner rotor which is connected to a camshaft for conjoint rotation therewith and can be rotatably adjusted relative to an outer rotor connected in terms of drive to a crankshaft. At least one hydraulic chamber delimited by side walls is introduced into the outer rotor. This chamber is divided by an element extending radially outwards from the inner rotor into two subchambers. To lock the relative motion between the inner rotor and the outer rotor, there are two locking pins which pass axially through the inner rotor and can engage in two apertures introduced into one of the side walls, the latter being designed as locking covers. The locking cover consists of two parts, wherein each of the parts has an aperture for the engagement of a respective locking pin.

DE 10 2013 223 301 A1 shows a camshaft adjusting device that has a stator, which can be connected to a crankshaft of an internal combustion engine, a rotor, which is mounted so as to be rotatable relative to the stator and can be connected to a camshaft, and a locking device for locking the rotor relative to the stator. The locking device has a locking guide slot produced by powder metallurgy, which is fixed relative to the stator or rotor, and at least one locking pin, which can be locked in the locking guide slot. The locking guide slot has a greater density in at least one section of the surface edge zone than the density of the basic material of the locking guide slot.

DE 10 2013 224 862 A1 shows a camshaft adjusting device that has a stator, which can be connected to a crankshaft of an internal combustion engine, a rotor, which is mounted so as to be rotatable relative to the stator and can be connected to a camshaft, and a locking device for locking the rotor relative to the stator. The locking device has a locking guide slot, which is fixed relative to the stator, and at least one locking pin, which is fixed relative to the rotor and can be locked in the locking guide slot. The locking guide slot is arranged in an at least two-part cover which is fixed relative to the stator and rests laterally against the rotor. The two parts of the cover can be fastened at different rotational angles relative to one another, wherein the locking guide slot is formed by at least one aperture provided in a first part of the cover, and a projection that engages in the aperture is provided on a second part of the cover.

DE 10 2016 218 793 A1 shows a camshaft adjuster having an input element and an output element that can be rotated within an angular range relative to the input element and can be connected to a camshaft. Pressurizable working chambers for the rotation of the input element relative to the output element are formed between the input element and the output element. The camshaft adjuster has a volume reservoir for collecting hydraulic medium, wherein the volume reservoir feeds the hydraulic medium via a check valve to a working chamber subject to a vacuum inasmuch as the vacuum in the working chamber opens the check valve. The check valve is arranged in an axial position between the working chamber and the volume reservoir, wherein the volume reservoir is formed by a cover element connected to the input element for conjoint rotation therewith.

The prior art furthermore includes a hydraulic camshaft adjuster that has a pressure medium reservoir and a "smart-phasing function", in which the working chambers can draw in additional pressure medium from a reservoir in the event of an undersupply of pressure medium by the pressure medium pump in order to avoid drawing in air and an associated malfunction of the hydraulic camshaft adjuster.

The disadvantage here is that the functioning of a hydraulic ratchet depends heavily on the pressure medium supply and the viscosity of the pressure medium. At low temperatures, functioning may be restricted or may fail owing to the flow resistances, which are then high. In the case of a normal engine stop, this plays no role since the pressure medium is heated by the operation of the engine and has a low viscosity. If the motor is shut down without locking, e.g. due to stalling, the hydraulic camshaft adjuster should lock the internal combustion engine as a failsafe function when the engine is started. If the engine start takes place after prolonged cooling at a low ambient temperature, the hydraulic ratchet may fail and locking in the central locking position may not occur.

SUMMARY

It is the object of the disclosure to develop a hydraulic camshaft adjuster with a smart phasing function in such a way that operationally reliable locking of the rotor in the central locking position takes place, irrespective of external conditions, and the disadvantages known from the prior art are overcome.

According to the disclosure, the object is achieved by a hydraulic camshaft adjuster for adjusting the timings of gas exchange valves of an internal combustion engine, having a stator, which is synchronously rotatable with a crankshaft of the internal combustion engine, and a rotor, which is arranged so as to be rotatable relative to the stator and is synchronously rotatable with a camshaft. The hydraulic camshaft adjuster furthermore has two groups of working chambers, which can each be supplied with a pressure medium flowing in or out in a pressure medium circuit and have a different direction of action. A central locking device for locking the rotor in a defined position relative to the stator is furthermore provided on the hydraulic camshaft adjuster. The stator is delimited at a first end by a multi-part locking cover, wherein the multi-part locking cover has a first locking cover and a second locking cover. In this arrangement, a first step of a mechanical ratchet is formed on the first locking cover, and at least one further step of the mechanical ratchet is formed on the second locking cover. It is thereby possible to form a mechanical ratchet mechanism which assists rotation of the rotor into the central locking position and thus makes the central locking function substantially independent of the viscosity of the pressure medium.

According to the disclosure, a check valve plate is arranged between the first locking cover and the second locking cover. The check valve plate is thereby protected by the hardened first locking cover from friction by the rotor and the locking pins, and a more advantageous arrangement of the check valve outlets is possible. The check valves allow an appropriate pressure medium supply to the working chambers, wherein, in the event of an undersupply to a working chamber and a reduced pressure resulting therefrom, the additional pressure medium can flow into the respective working chamber from a reservoir.

Advantageous improvements and developments of the hydraulic camshaft adjuster are possible by means of the features described herein.

In an example embodiment of the disclosure, it is envisaged that at least one insert is provided on the second locking cover, which insert can be brought into operative connection with a locking pin of the central locking device. Since the shock loads on the locking mechanism are high, it is worthwhile and expedient to reinforce the region of the locking guide slot on the second locking cover. This can be accomplished in a simple manner by means of an insert.

A stop for the locking pin can be formed on the insert. By means of a stop on the insert, the forces of the locking pin are transmitted only indirectly to the second locking cover, with the result that the mechanical load on the second locking cover remains relatively low. This allows simple and low-cost manufacture of the second locking cover since, in this case, easily machined materials and/or advantageous manufacturing methods can be employed.

In an example embodiment of the invention, it is envisaged that the step for the operation of the hydraulic ratchet is formed on the insert. As a result, the locking pin can be rotated in steps together with the rotor from its initial position into the central locking position. In addition, the forces during the latching in of the locking pin at the position of the axially extending stop surface of the step are absorbed by the insert, with the result that the load on the basic material of the second locking cover remains low and the risk of operationally induced material fatigue or of increased wear can be lowered.

It is envisaged that the insert can be composed of a harder and higher-strength material than the material of the second locking cover. By means of a hard and tough material for the insert, the wear on the central locking device can be lowered and the durability of the locking mechanism can be increased.

The insert can be composed of a sintered metal or produced by means of a fine blanking or extrusion method. By means of a high-strength sintered metal or a fine blanking or extrusion press for the insert, the strength of the second locking cover as a two-component part can be increased, wherein the region of the locking guide slot which is subject to high mechanical loads can be made correspondingly harder and more impact resistant. A steel, e.g. a C45 steel, can be provided as the material for a fine-blanked part, for example. A part composed of a 16MnCr5 steel is provided as an extruded part, for example, said part subsequently being hardened. The locking cover can be composed of a sintered metal, e.g. Sint-D11. As an alternative, it is also possible for the locking cover to be produced as a fine-blanked part composed of a steel such as C45, 16MnCr5 or S460MC, wherein the locking cover can furthermore additionally be hardened, thus making it possible to dispense with an insert and thus to reduce the outlay on assembly and the number of parts.

In an alternative embodiment of the invention, it is envisaged that the insert is pressed into a guide slot base of the central locking device on the second locking cover. In this case, a hard, impact-resistant insert can be pressed into the guide slot base of the central locking device on the second locking cover, and therefore the insert can also be embodied as a stamped, milled or turned part. By means of the press-fitting, a nonpositive and operationally reliable connection between the insert and the second locking cover is achieved.

The insert can be secured against tilting or falling out of the second locking cover by the check valve plate. As an alternative or in addition, the insert can be fixed on the second locking cover by means of a shoulder on the check valve plate or by bending over the check valve plate, with the result that the check valve plate serves as a means of securing the insert on the second locking cover.

As an alternative to a stepped insert, a formed check valve plate could also fix a simple, unstepped insert, optionally embodied as a stamping, in its position.

Furthermore, it is also possible to provide a plurality of inserts stacked one on top of the other instead of a single inserts, wherein a step can be formed by the differing geometry of the inserts. This enables the inserts to be embodied in a particularly simple and low-cost way as stampings.

A method for producing a hydraulic camshaft adjuster can have the following steps, wherein the stator is delimited at a first end by a multi-part locking cover, wherein a first step of a mechanical ratchet is formed on the first locking cover, and at least one further step of a mechanical ratchet is formed on the second locking cover, and wherein the hydraulic camshaft adjuster additionally has a hydraulic ratchet mechanism, by means of which the rotor is rotated into a central locking position. This makes it possible to produce a rotor for a hydraulic camshaft adjuster with central locking in which there are both a hydraulic ratchet and a mechanical ratchet, thus enabling the rotor to be rotated into the central locking position in a manner substantially independent of the viscosity of the pressure medium and facilitating locking in the central locking position. In this case, the mechanical ratchet and the hydraulic ratchet can contribute simultaneously to the adjustment of the rotor into the central locking position. The hydraulic ratchet acts when the outflow from the working chamber that pushes toward the central locking position is closed. The locking pin closes this outflow in the locked position. In the intermediate latching position of the mechanical ratchet, it continues to be held closed. Because of the locking depth, required for this purpose, through the first locking cover, it is advantageous if the insert is of stepped design.

Unless stated otherwise in individual cases, combining the various embodiments of the invention which are mentioned in the present application is an advantageous possibility.

BRIEF DESCRIPTION OF THE DRAWINGS

The disclosure is explained in greater detail below by means of an illustrative embodiment and the associated drawings. Here, components that are the same or components with the same function are denoted by the same reference numerals. In the drawings.

DETAILED DESCRIPTION OF THE EMBODIMENTS

Figure 1:
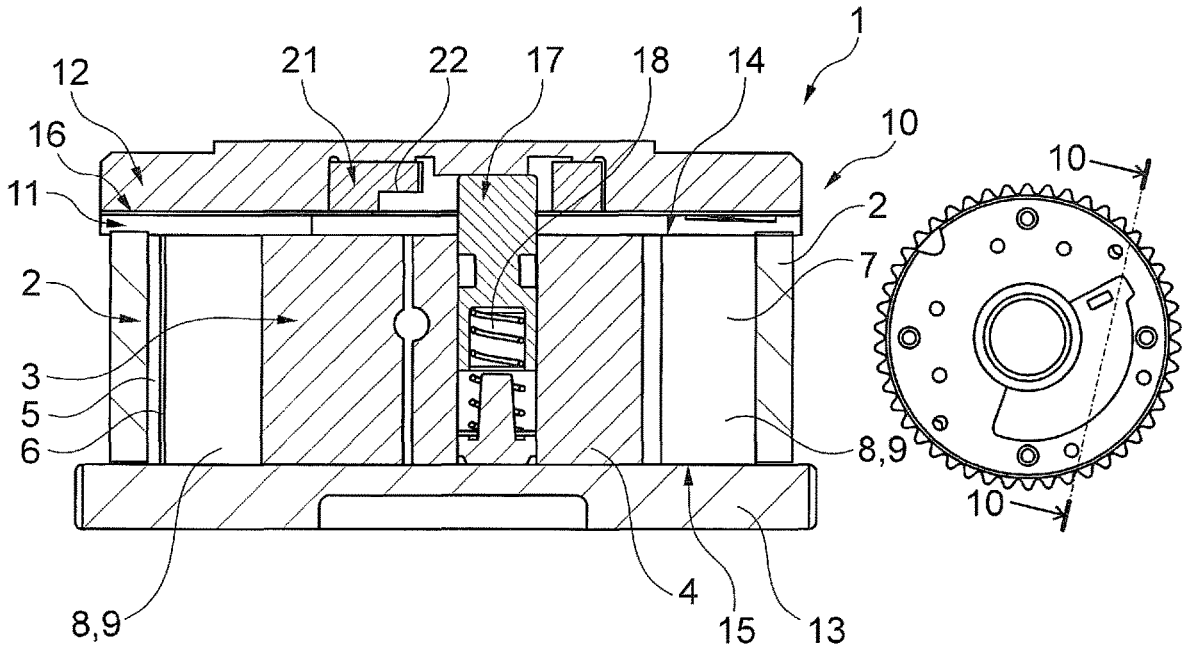
FIG. 1 shows an illustrative embodiment of a hydraulic camshaft adjuster according to the disclosure in section.

FIG. 1 illustrates an embodiment example of a hydraulic camshaft adjuster 1 according to the disclosure for adjusting the valve timings of an internal combustion engine. The hydraulic camshaft adjuster 1 illustrated schematically in FIG. 1 is designed in a known manner as a rotary vane adjuster and comprises a stator 2, which can be driven by a crankshaft (not illustrated) of an internal combustion engine, and a rotor 3, which can be connected to a camshaft (likewise not illustrated) for conjoint rotation therewith. The rotor 3 has a rotor hub 4, from which a plurality of vanes 6 extends in a radial direction. The stator 2 has a plurality of ridges 5, which divide an annular space between the stator 2 and the rotor 3 into a plurality of pressure spaces 7. The pressure spaces 7 are each divided by the vanes 6 of the rotor 3 into two working chambers 8, 9 with different directions of action. In addition to the working chambers 8, 9 known in the normal operation of the hydraulic camshaft adjuster 1, support chambers for hydraulic support of the rotor 3 during rotation into a central locking position are provided between the rotor 3 and the stator 2. The stator 2 is delimited at a first end 14 by a multi-part locking cover 11, 12 and at a second end 15 situated opposite the first end 14 by a sealing cover 13. An additional reservoir cover, which has a reservoir for pump-independent supply of pressure medium to the working chambers 8, 9, can be mounted on the multi-part locking cover 11, 12. The multi-part locking cover 11, 12 has a first locking cover 11, which is connected to the stator 2 for conjoint rotation therewith. The multi-part locking cover 11, 12 furthermore has a second locking cover 12, which is connected to the first locking cover 11 and/or to the stator 2 for conjoint rotation therewith. An insert 21, which can be of single-part or multi-part design, is inserted into the second locking cover 12. The insert is can be a stepped insert 21, as illustrated in FIG. 1, and has a step 22, on which a locking pin 17 of a central locking device 10 of the hydraulic camshaft adjuster 1 can come to rest. The locking pin 17 is preloaded by the force of a spring 18 and can be pushed into the rotor 3 hydraulically by corresponding pressure buildup by the pressure medium. A check valve plate 16, which has check valves 27 for supplying the working chambers 8, 9 hydraulically with the pressure medium, is arranged between the first locking cover 11 and the second locking cover 12. Sprocket toothing, via which the stator 2 can be connected to a chain or a toothed belt to the crankshaft of the internal combustion engine, is furthermore formed on the stator 2 of the hydraulic camshaft adjuster 1.

Figure 2:
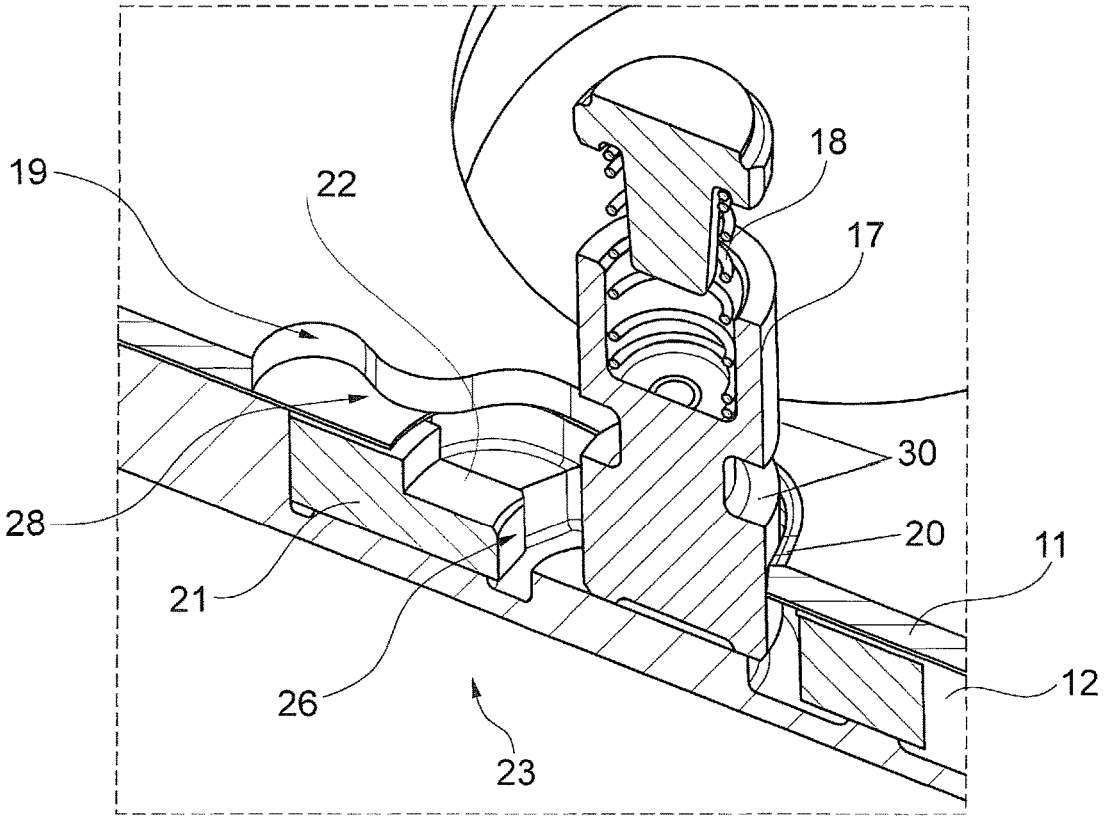
FIG. 2 shows the two-part locking cover of a hydraulic camshaft adjuster according to the disclosure.

The two-part locking cover 11, 12 of the central locking device 10 is illustrated on an enlarged scale in FIG. 2. Here, the hydraulic camshaft adjuster 1 can be seen locked in the central position. An aperture 19 for connection of a pressure medium feed duct, via which the locking mechanism of the central locking device 10 can be hydraulically controlled, is provided in the first locking cover 11. A stop 20 for the locking pin 17 of the central locking device 10, which limits a rotation of the rotor 3 in the corresponding direction, is furthermore provided on the first locking cover 11. An insert 21 having a step 22, which is held in position in the axial direction by the check valve plate 16, is inserted into the second locking cover 12. For this purpose, an axial securing means 28, which overlaps at least a section of the insert 21, is formed on the check valve plate 16. In addition, a further stop 26 for the locking pin 17 is formed on the insert 21, resulting in a mechanical ratchet 23 by means of which the rotor 3 can be rotated in steps into the central locking position. The locking pin 17 is pushed into the locking guide slot of the central locking device 10 on the second locking cover 12 by the spring 18, wherein the locking pin 17 blocks a duct 29, illustrated in FIG. 4, for controlling the hydraulic ratchet mechanism when the locking pin 17 is locked in the locking guide slot. Provided on the locking pin 17 is a recess 30, by means of which the duct 29 for controlling the hydraulic ratchet mechanism can be opened when the locking pin 17 is pushed into the rotor 3 by the hydraulic pressure of the pressure medium. The hydraulic ratchet mechanism is thereby deactivated, and the pressure medium can flow out of the corresponding working chambers 8, 9.

Figure 3:
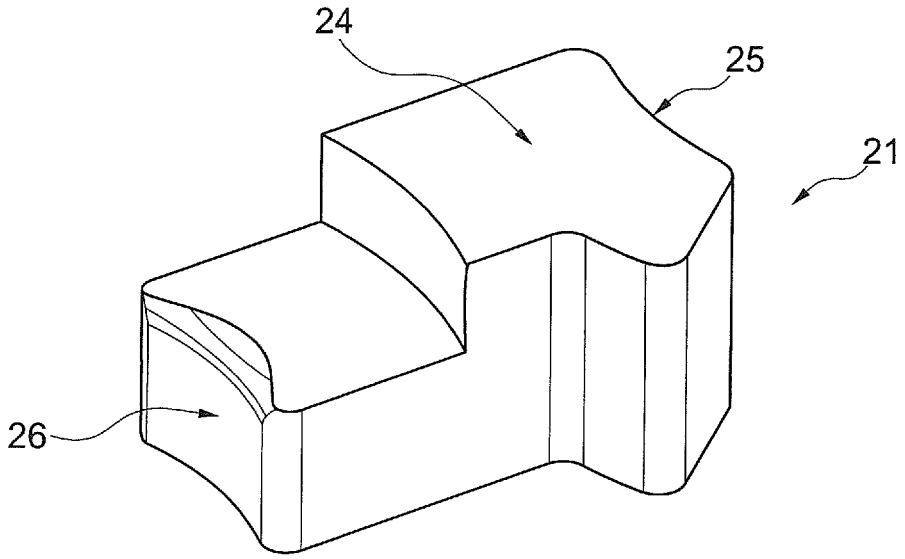
FIG. 3 shows an enlarged illustration of an insert into the locking cover.

A stepped insert 21 is shown in an enlarged illustration in FIG. 3. The insert 21 has a main body with a raised portion 24, by means of which the insert 21 is supported on the check valve plate 16, and a step 22. In this case, a rest 25, by means of which the insert 21 can be supported on the locking cover 12, is provided on the base part. A stop 26 for the locking pin 17, which prevents a rotary motion of the rotor 3 by positive engagement, can furthermore be seen on the insert 21.

Figure 4:
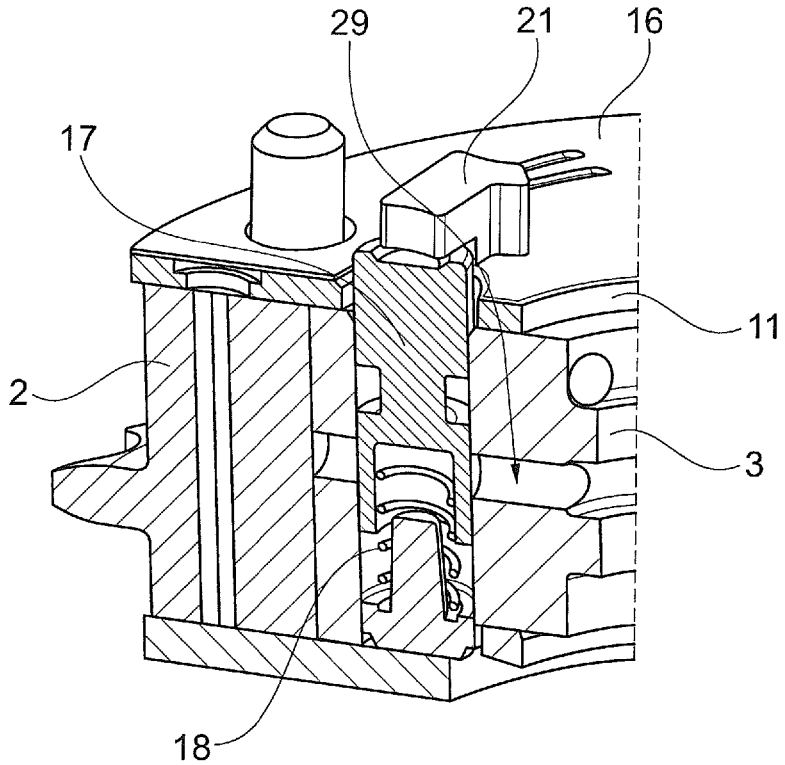
FIG. 4 shows a diagram intended to illustrate the interplay between the mechanical and the hydraulic ratchet function in a hydraulic camshaft adjuster according to the disclosure, in which one of the locking pins is locked.

A segment of a hydraulic camshaft adjuster 1 is shown in a sectioned three-dimensional illustration in FIG. 4. Here, the rotor 3 has already been locked on one side in the central locking device 10, and the duct 29 to the working chamber 8, 9 is blocked by the locking pin 17. The rotor 3 is in mechanical stop contact, by means of its vane 6, with a ridge 5 of the stator 2.

Figure 5:
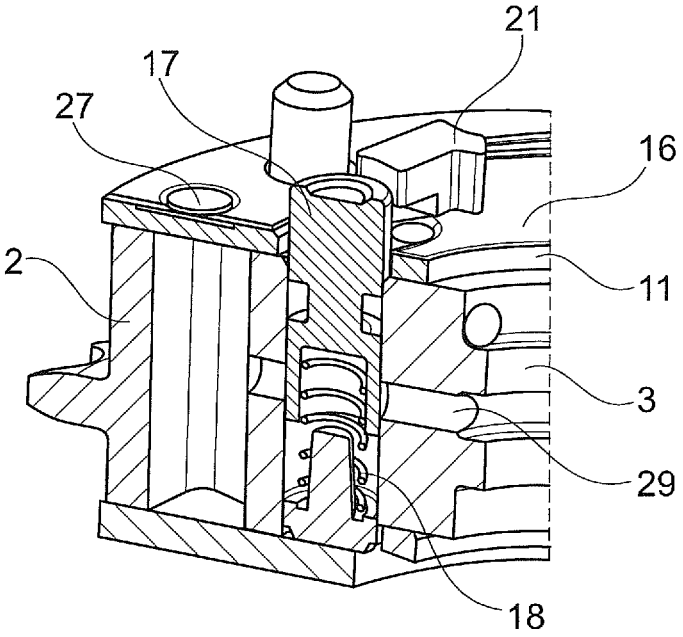
FIG. 5 shows a second diagram intended to illustrate the interplay between the mechanical and the hydraulic ratchet function in a hydraulic camshaft adjuster according to the disclosure, in which the outflow from the working chamber which pushes toward the central locking position is closed.

Another segment of a hydraulic camshaft adjuster 1 is illustrated in FIG. 5, wherein the locking pin 17 rests against a step of the mechanical ratchet 23 but is not yet in the central locking position. The duct 29 for hydraulic control of the working chambers 8, 9 is furthermore blocked by the locking pin 17, and therefore no pressure medium can flow out of the corresponding working chamber 8, 9. Thus, the mechanical ratchet 23 and the hydraulic ratchet mechanism are active simultaneously.

Figure 6:
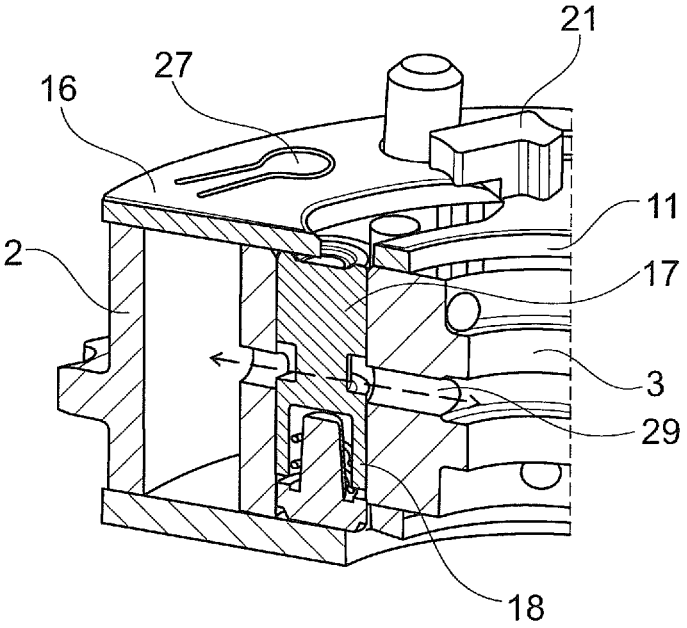
FIG. 6 shows a third diagram intended to illustrate the interplay between the mechanical and the hydraulic ratchet function in a hydraulic camshaft adjuster according to the disclosure, in which the outflow from the working chamber which pushes toward the central locking position is open.

A third illustration of a segment of the hydraulic camshaft adjuster 1 is shown in FIG. 6. In this operating state, the locking pin 17 has been pushed into the rotor 3, with the result that the recess 30 on the locking pin 17 exposes the duct 29 to the working chambers 8, 9, thus ensuring that the pressure medium can flow out of the working chambers 8, 9 and that the hydraulic ratchet mechanism is deactivated. In this case, the rotor 3 is unlocked and freely rotatable, thus providing the operation-related adjusting function of the hydraulic camshaft adjuster 1.

The functioning of the hydraulic ratchet mechanism depends on the oil supply and on the temperature-dependent viscosity of the pressure medium. At low temperatures, the functioning of the hydraulic ratchet mechanism can fail owing to the flow resistances, which are then high. This plays a role especially when an internal combustion engine is shut down unexpectedly, e.g. by stalling, shortly after a cold start, and the hydraulic camshaft adjuster 1 remains unlocked. If the engine is started with cold and thus viscous pressure medium, the hydraulic ratchet mechanism may fail. To cover a failsafe function of the hydraulic camshaft adjuster 1, an additional mechanical ratchet 23 is employed. This comprises a step in which the locking pin 17 can latch in between the end stop positions and the central locking position.

The mechanical ratchet 23 and the hydraulic ratchet can and should contribute simultaneously to the adjustment of the rotor 3 into the central locking position. The hydraulic ratchet acts when the outflow 29 from the working chamber 8, 9 that pushes toward the central position is closed. The locking pin 17 closes this outflow 29 in the locked position. In the intermediate latching position of the mechanical ratchet 23, it continues to be held closed. Because of the locking depth, required for this purpose, through the first locking cover 11, the insert 21 can be of stepped design, or a step 22 can be provided in some other way. The insert 21 in the second locking cover 12 is no longer secured axially against tilting due to shock loads by the extended locking guide slot and the aperture for the connection of the pressure medium supply for hydraulic unlocking of the central locking device 10 in the first locking cover 11. The check valve plate 16 situated between the first locking cover 11 and the second locking cover 12 is therefore used as a securing means.

In the example embodiment illustrated, the mechanical ratchet 23 is formed only in the "retarded" direction of adjustment from the center and not in the "advanced" direction of adjustment since in this case no spiral spring is employed to compensate the camshaft friction torque. For adjustment out of the "advanced" direction of adjustment into the central locking position, the corresponding camshaft friction torque can exert a supportive effect, with the result that no additional mechanical ratchet 23 is required in this direction. In principle, the mechanical ratchet 23 can also be formed in both directions of adjustment and thus on both sides of the central locking position. In this case, an additional stepped insert 21 can be provided and inserted into the second locking cover 12. If the additional mechanical ratchet is used on the same locking pin 17 as the mechanical ratchet 23 illustrated in the embodiment example, the stepped insert should produce a reverse switching logic for the hydraulic ratchet mechanism, with the result that the hydraulic connection 29 to the working chambers 8, 9 is held open in the intermediate latching position. A mechanical ratchet 23 having a plurality of steps and finer gradation associated therewith is furthermore conceivable, wherein a multiple-step insert 21 can be used for this purpose.

In the case of a hydraulic camshaft adjuster 1 according to the disclosure, it is thus possible to improve the rotation of the rotor 3 into the central locking position even at a low temperature and a high viscosity of the pressure medium and thus to ensure operationally reliable locking in the central locking position, irrespective of the external boundary conditions.

LIST OF REFERENCE CHARACTERS

1 hydraulic camshaft adjuster
2 stator
3 rotor
4 rotor hub
5 ridge
6 vane
7 pressure space
8 working chamber
9 working chamber
10 central locking device
11 first locking cover
12 second locking cover

13 sealing cover
14 first end
15 second end
16 check valve plate
17 locking pin
18 spring
19 aperture (in the first locking cover)
20 stop
21 insert
22 step on the insert
23 mechanical ratchet
24 raised portion
25 rest
26 stop
27 check valve
28 axial securing means
29 duct to hydraulic ratchet
30 recess on locking pin

The invention claimed is:

1. A hydraulic camshaft adjuster for adjusting timing of gas exchange valves of an internal combustion engine, the hydraulic camshaft adjuster comprising:

a stator configured to be synchronously rotatable with a crankshaft of the internal combustion engine, a rotor configured to be rotatable relative to the stator and synchronously rotatable with a camshaft, two groups of working chambers formed by the stator and rotor, the two groups of working chambers configured to be supplied a pressure medium flowing in or out in a pressure medium circuit, a central locking device for locking the rotor in a defined position relative to the stator, the stator delimited at a first end by a multi-part locking cover, the multi-part locking cover having a first locking cover and a second locking cover, and a first step of a mechanical ratchet formed on the first locking cover, and at least one second step of the mechanical ratchet formed on the second locking cover, and a check valve plate arranged between the first locking cover and the second locking cover.

2. The hydraulic camshaft adjuster as claimed in claim 1, wherein the second locking cover includes at least one insert configured to operatively connect with a locking pin of the central locking device.

3. The hydraulic camshaft adjuster as claimed in claim 2, wherein a stop for the locking pin is formed on the at least one insert.

4. The hydraulic camshaft adjuster as claimed in claim 2, wherein the at least one second step of the mechanical ratchet is formed on the at least one insert.

5. The hydraulic camshaft adjuster as claimed in claim 2, wherein the at least one insert is composed of a harder material than a material of the second locking cover.

6. The hydraulic camshaft adjuster as claimed in claim 5, wherein the at least one insert is composed of a sintered metal or is produced by a fine blanking or extrusion method.

7. The hydraulic camshaft adjuster as claimed claim 2, wherein the at least one insert is pressed into a guide slot base of the central locking device.

8. The hydraulic camshaft adjuster as claimed in claim 2, wherein the at least one insert is secured against tilting or falling out by the check valve plate.

9. A hydraulic camshaft adjuster for adjusting timing of gas exchange valves of an internal combustion engine, the hydraulic camshaft adjuster comprising:

a stator configured to be synchronously rotatable with a crankshaft of the internal combustion engine, a rotor configured to be rotatable relative to the stator and synchronously rotatable with a camshaft, a central locking device for locking the rotor to the stator, the stator delimited at a first end by a multi-part locking cover, the multi-part locking cover having a first locking cover and a second locking cover, and a first step of a mechanical ratchet formed on the first locking cover, and at least one second step of the mechanical ratchet formed on the second locking cover, and a check valve plate arranged between the first locking cover and the second locking cover.

10. The hydraulic camshaft adjuster as claimed in claim 9, wherein the central locking device comprises a locking pin configured to move and stop at three different positions.

11. The hydraulic camshaft adjuster as claimed in claim 10, wherein the locking pin is configured to move to a locked position, an intermediate position, and an unlocked position.

12. The hydraulic camshaft adjuster as claimed in claim 10, wherein in the locked position and the intermediate position, the rotor is locked to the stator.

13. The hydraulic camshaft adjuster as claimed in claim 12, wherein the locking pin includes a recess configured to receive a pressure medium.

14. The hydraulic camshaft adjuster as claimed in claim 13, wherein in the unlocked position of the locking pin, the recess is configured to fluidly connect a duct arranged within the rotor to a working chamber of the hydraulic camshaft adjuster.

15. The hydraulic camshaft adjuster as claimed in claim 9, wherein the second locking cover includes at least one insert configured to operatively connect with a locking pin of the central locking device.

16. The hydraulic camshaft adjuster as claimed in claim 15, wherein a stop for the locking pin is formed on the at least one insert.

17. The hydraulic camshaft adjuster as claimed in claim 16, wherein the at least one second step of the mechanical ratchet is formed on the at least one insert.

18. The hydraulic camshaft adjuster as claimed in claim 15, wherein the first locking cover is arranged to engage the rotor.

19. The hydraulic camshaft adjuster as claimed in claim 16, wherein the first locking cover includes an aperture configured to receive pressure medium to move the locking pin.

20. The hydraulic camshaft adjuster as claimed in claim 15, wherein the check valve plate secures the at least one insert within the second locking cover.

* * * * *